US010398953B2

(12) United States Patent
Klevana et al.

(10) Patent No.: US 10,398,953 B2
(45) Date of Patent: Sep. 3, 2019

(54) TRAVEL COVER

(71) Applicant: Dynamic Brands, LLC, Richmond, VA (US)

(72) Inventors: Leighton Klevana, Richmond, VA (US); Patrick Gallagher, Midlothian, VA (US)

(73) Assignee: Dynamic Brands, LLC, Richmond, VA (US)

( * ) Notice: Subject to any disclaimer, the term of this patent is extended or adjusted under 35 U.S.C. 154(b) by 0 days.

(21) Appl. No.: 15/644,960

(22) Filed: Jul. 10, 2017

(65) Prior Publication Data

US 2019/0009152 A1 Jan. 10, 2019

(51) Int. Cl.
*A63B 55/60* (2015.01)
*A63B 55/00* (2015.01)

(52) U.S. Cl.
CPC ..... *A63B 55/406* (2015.10); *A63B 55/60* (2015.10)

(58) Field of Classification Search
CPC ..... A63B 55/406; A63B 55/60
USPC ..... 206/315.4; 150/159
See application file for complete search history.

(56) References Cited

U.S. PATENT DOCUMENTS 2,907,364 A * 10/1959 Trenery ..... A63B 55/406 150/159
4,657,135 A * 4/1987 Kjose ..... A63B 55/00 206/315.3
4,876,416 A 10/1989 Frantz
5,813,504 A 9/1998 Iny
6,161,698 A * 12/2000 Bradshaw ..... A63B 55/60 206/527
6,164,425 A * 12/2000 Latshaw ..... A45C 5/14 190/108
6,330,944 B1 * 12/2001 DeMichele ..... A63B 55/60 206/315.3
6,401,890 B1 * 6/2002 Tan ..... A45C 5/14 150/159
6,557,702 B1 * 5/2003 Sanderson ..... A45C 5/02 206/315.4
6,763,940 B1 * 7/2004 Lai ..... A45C 5/14 206/315.1
6,901,979 B1 * 6/2005 Herold ..... A63B 55/406 150/159
7,077,252 B2 * 7/2006 Sanchez ..... A45C 7/0045 150/159
7,468,025 B2 12/2008 Hauser
8,215,465 B2 * 7/2012 Iceberg ..... A45C 3/001 190/125
8,794,409 B2 8/2014 Klevana
8,876,677 B2 11/2014 Meininger
9,168,785 B2 10/2015 Spektor
(Continued)

*Primary Examiner* — Sue A Weaver
(74) *Attorney, Agent, or Firm* — Bernard G. Pike; Pike IP Law, PLLC

(57) ABSTRACT

Travel covers protect and transport sports equipment or other objects during travel in cars, trains, walking or airlines. Typical travel covers have a handle attached to an enclosure having at least one wheel. The travel covers may have a cradle on an interior surface of an enclosure for receiving a potentially abrasive wear portion of the sporting equipment or other object to protect the travel cover from wear. The travel cover may be for a golf bag and clubs, where the cradle receives a portion of the stand mechanism for a golf stand bag or a connection portion for a golf cart bag.

20 Claims, 4 Drawing Sheets

(56) References Cited

U.S. PATENT DOCUMENTS

| | | | | |
|---|---|---|---|---|
| 9,616,313 | B2 | 4/2017 | Townsend | |
| 2005/0085352 | A1 | 4/2005 | Baxter | |
| 2008/0202872 | A1 | 8/2008 | Huan | |
| 2009/0255841 | A1* | 10/2009 | Sanches | A45C 13/021<br>206/522 |
| 2010/0210431 | A1 | 8/2010 | Hinton | |

* cited by examiner

TRAVEL COVER

FIELD OF THE INVENTION

The invention is directed to luggage and travel covers for carrying sports equipment or other objects that need protection during transportation. Embodiments of the travel covers comprise a cradle for receiving a potentially abrasive wear portion of the sporting equipment or other object. In a specific embodiment, the travel cover may comprise a cradle for receiving a portion of a golf stand bag. The cradle may comprise three protrusions and/or raised ridges wherein the three protrusions and/or raised ridges define recesses for receiving potentially abrasive wear portions on the golf bag.

BACKGROUND

Luggage, duffel bags, travel bags and travel covers including travel covers for sporting goods such as, but not limited to, travel covers for golf bags (collectively. "travel covers"), for example, are commonly used for conveniently transporting and protecting golf clubs and golf bags during travel by walking, car, train and/or airplane.

The travel cover may have wheels to assist in moving the travel cover and a golf bag and/or other objects within the travel cover. A golf bag, for example, may be placed in an inner volume of the enclosure of the travel cover to protect the golf bag and its contents. The travel cover protects the golf bag and its contents, however, over time the golf bag and/or clubs may damage the interior of the travel cover. Metal, hard plastic or other components of the golf bag and/or clubs may wear out portions the travel cover from the inside from continued rubbing, for example. Specifically, portions of the golf bag may rub wear out portions or wear holes from constant rubbing on the inner surface of the enclosure, especially for fabric enclosures. The back panel or bottom panel may experience more severe wear than other portions since they will more consistently bear the weight of the golf bag or other objects within the travel cover.

There exists a need for a travel cover with a cradle or other support and/or protection to reduce abrasion of the interior surface of the enclosure. There exists a further need for a travel cover that has a cradle that prevents wear and reduces movement of the golf bag within the travel cover to protect both the travel cover and the its contents from damage.

SUMMARY

Travel covers are used to protect a variety of objects during transport including traveling by walking, car, train and/or airplane. To prevent damage and provide a convenient article for storing and transporting golf bags, golf clubs or other objects, the golf bags, golf clubs or other objects are placed in a travel cover. For example, as shown in FIG. 1, a golf bag travel cover may be used to protect a golf bag and golf clubs from damage. Golf bag travel covers are typically used by golfers to protect and ease transporting their golf clubs during air travel. There is a significant chance of damage to the golf clubs as they are put in a trunk of a car, carried through an airport, and loaded into and transported in a baggage compartment of a train or airplane. Travel covers have tough enclosures that protect golf bags and/or other objects to be transported. The enclosures of a travel cover may comprise flexible, rigid, or a combination of flexible and rigid components. For example, an embodiment of the golf bag travel cover 10 is shown in FIG. 1.

The travel covers protect the golf bag, golf clubs and/or other objects within the travel cover from damage with a tough exterior, however, the golf bag, golf clubs or other objects may damage the travel cover contact from the inside of the enclosure. For example, for a golf travel cover, the golf bag may have hard components or wear portions that contact the inner surface of the enclosure of the travel cover at a similar location whenever the golf bag is within the enclosure. During transport by carrying or rolling on the wheels or in a vehicle, the golf bag will consistently rub the inner surface of the enclosure at that location causing damage. Since most golf bags have similar shapes and design, the golf bags contact the inner surface of the enclosure at similar places. Over time, the damage to the enclosure of the travel cover may become significant and, in some cases, a hole may be worn in the enclosure allowing damage to the golf bag or golf clubs and water and dirt to entire the enclosure. This is especially true for fabric enclosures.

In an embodiment of the travel cover, the travel cover comprises a cradle, a connector, protrusion, raised panels or ridges, reinforcing pad or patch, and/or at least one recess to receive a portion of the golf bag or other object (hereinafter, "cradle") to prevent or reduce wear, tears or other damage on the inner surface of the travel cover. In a more specific embodiment, the travel cover comprises an enclosure defining an inner volume 33 wherein the inner volume 33 is dimensioned to receive a golf bag and at least one cradle to protect an inner surface of the enclosure from wear.

The travel cover may comprise an opening providing access to the inner volume for inserting and removing content, such as a golf bag, from the travel cover. Further, the travel cover may comprise a back panel having a top end and a bottom end, wherein the top end of the back panel comprises a cradle. In one embodiment, the cradle defines a first recess and the first recess is located to receive a first protrusion or other wear portion connected to a top portion of the golf bag.

In one embodiment, the cradle comprises three raised portions extending from the top end of the back panel into the inner volume and define a first recess and a second recess between the three raised portions. The cradle is positioned on the back panel such that a first protrusion and the second protrusion on the top portion of the golf bag are received within the two recesses defined in the cradle. The cradle thereby reduces wear on the back panel by the protrusions or other wear portions. The back panel may be on an opposite side of the travel cover from the opening and will typically bear the weight of the golf bag or other objects within the travel cover during use.

The protrusions on the golf bag may be part of the top member and/or part of a golf bag stand mechanism. For example, the golf bag may be a stand golf bag having a first support leg and a second support leg. In such a case, the first support leg may be connected to the first protrusion and the second support leg may be connected to the second protrusion. In some embodiments, the support legs are hingedly connected to the protrusions.

In another embodiment, the protrusions on the golf bag may be designed to connect the golf bag to a golf cart. In such an embodiment, the golf bag has protrusions that are received within recess or other connector in a golf cart to secure the golf bag to the golf cart in use and the protrusions are received within recesses in the cradle of the travel cover when the golf bag is being stored or transported. Thus, in a specific embodiment, the golf bag, golf cart and travel cover comprise a kit of components.

In a still further embodiment, a golf bag with a travel cover comprises a top member defining an opening to place golf clubs. The top member comprises a first protrusion and a second protrusion defining a recess between the protrusions. In such an embodiment, the golf bag travel cover may comprise an enclosure defining an inner volume dimensioned to receive the golf bag, wherein the golf bag travel cover further comprises a cradle, wherein at least a portion of the cradle is received within the recess defined in the top member of the golf bag.

Other aspects and features of embodiments of the travel covers comprising at least one cradle will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DESCRIPTION OF EMBODIMENTS

Figure 1:
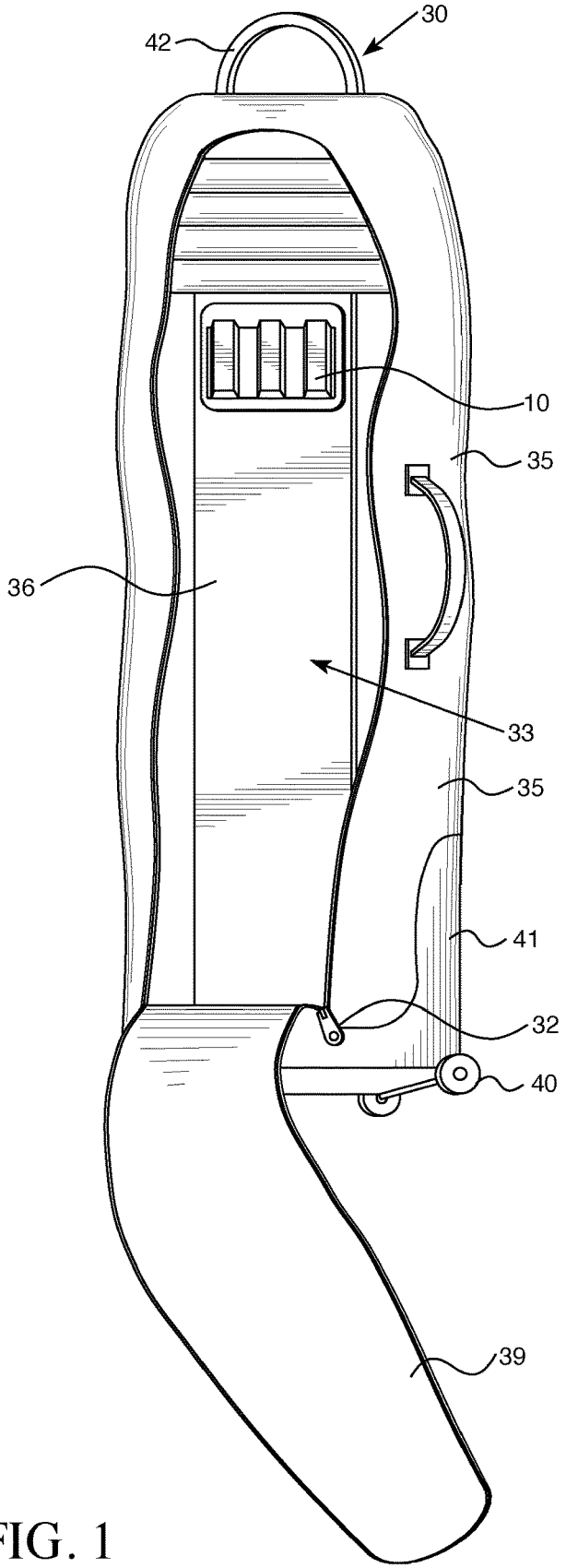
FIG. 1 depicts a travel cover for a golf bag comprising a cradle as described.

Travel covers are used to protect a variety of objects during transport. The travel cover may be used to protect the objects while traveling by walking, car, train and/or airplane as previously described. A golf bag travel cover (as shown in FIG. 1, for example) includes an enclosure to receive a golf bag, golf clubs, and optionally, golfing accessories. Golf bag travel covers are typically used by golfers to protect and ease transporting their golf clubs on airplanes as the golf bag and clubs are carried through the airport. There is a significant chance of damage to the golf clubs as they are lifted and thrown into a trunk of a car, carried through an airport, and loaded into and transported in a baggage compartment of a train or airplane. Typical travel covers have tough enclosures that protect golf bags and other objects during such transport. The enclosures of a travel cover may be made of a flexible material such as a tough, wear resistant fabrics, rigid materials such as a plastic, or have both rigid components and flexible components.

For example, an embodiment of the golf bag travel cover 30 shown in FIG. 1, includes a rigid base member 41, a pair of wheels 40, a flexible cover 37 including an enclosure door 39 and a back panel 36, and means for closing 32 the flexible cover 35 with the enclosure door 39.

In the embodiment shown in FIG. 1, the base member 41 allows the golf bag travel cover 30 to stand upright and comprises at least one wheel 40 for rolling the travel cover when the travel cover 30 is in a tilted position. The travel cover 30 may be leaned forward to shift the weight onto the wheels 40 and held by the handle 42 on the top portion of the travel cover 30. At this point, the back panel and the bottom of the travel cover are bearing the weight of its contents. The travel cover 30 may be easily pulled as a portion of the weight of the travel cover and its contents is supported by the wheels 40 and only a portion of the weight may be supported by a handle 42 by the user.

Figure 2:
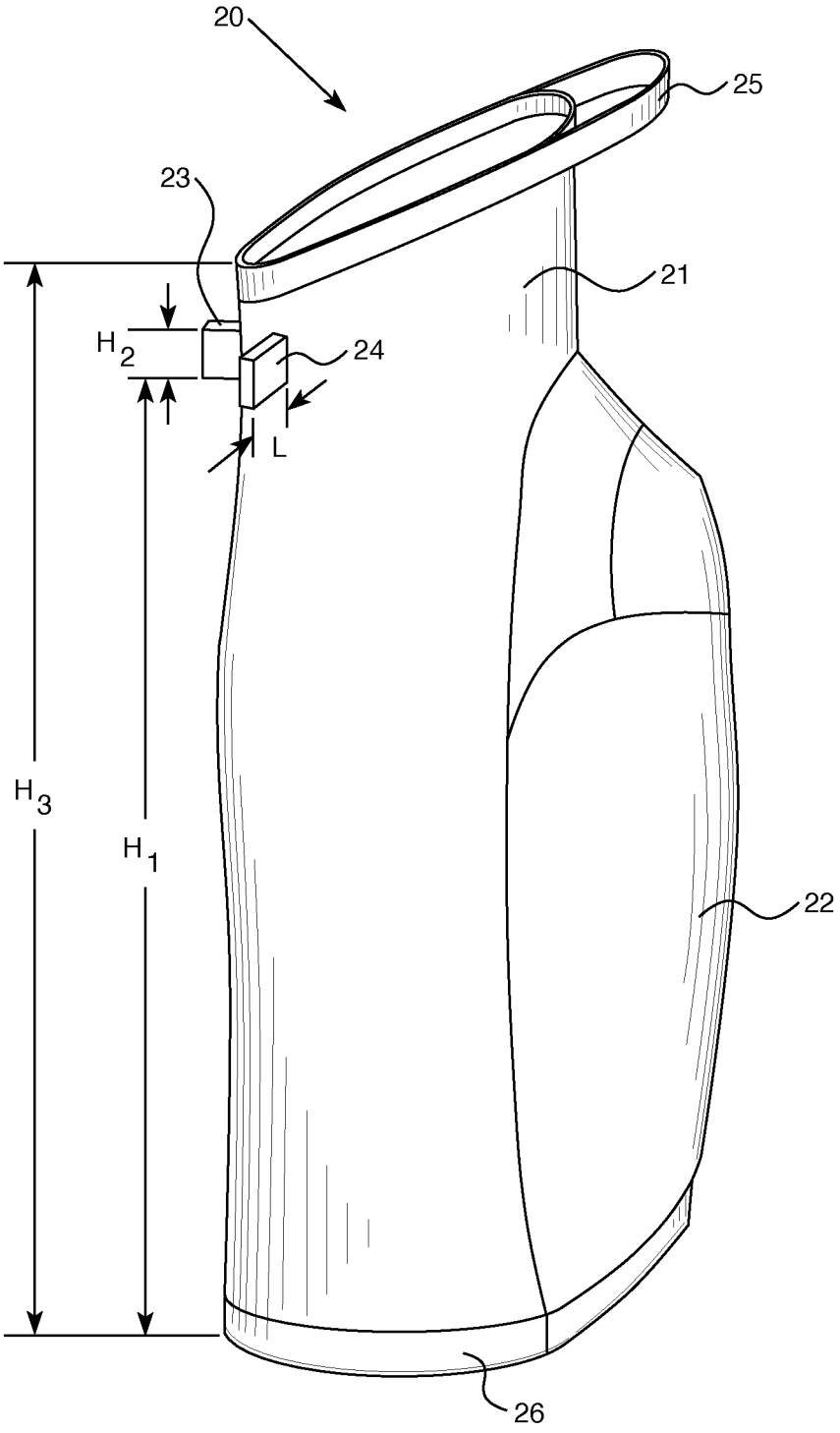
FIG. 2 depicts a golf bag having a wear portion comprising a first and second protrusion, in one embodiment the protrusions may be connected to a stand mechanism of a golf stand bag or may be connectors for a golf cart of a golf cart bag, for example.

In the tilted position or in the laying down position, a golf bag (such as the golf bag shown in FIG. 2) within the travel cover 30 will lay against the back panel 36. The golf bag within the travel cover will slide and rub against the back panel 36 which may cause damage to the back panel or other inside surface of the enclosure of the travel cover 30. In most cases, the golf bag or other object may comprise one or more of these wear portions that may ultimately cause damage to the travel cover. The wear portions may include, but are not limited to, hard plastic or metal protrusions or sharp edges on the golf bag, for example. If not abated, the wear on the enclosure may ultimately result in sufficient damage to the travel cover's 30 enclosure 35 and particularly the back panel 36 and end the useful life of the travel cover.

To prevent or reduce wear on the back panel 36 of the travel cover 30 or other inner surface, the embodiment of the travel cover 30 includes a cradle 10 on the back panel 36. The cradle may be any shape and material useful to reduce wear on the back panel. For example, the cradle may be U-shaped, saddle shaped, significantly circular or oval shaped, substantially semi-circular or semi-oval shaped, at least one protrusion extending from the back panel or a shape complementary to a wear portion of the golf bag or other object. In this embodiment, the cradle 10 is sized and positioned to receive the first protrusion 23 and/or the second protrusion 24 of the golf bag 20 shown in FIG. 2.

In a typical set of clubs, the set of irons for players of average skill will comprise about an approximately 39-inch long 3-iron as the longest iron down to approximately 36-inch long 9-iron. A typical driver is between 45.5 inches to 46.5 inches long but may be up to 48 inches long.

Since the golf clubs are retained within the travel cover, typically travel covers have an internal length from top to bottom surface in the range of between 46 inches and 52 inches. However, the travel covers may have any appropriate length to retain additional desired objects.

Further, golf bags will have a height at least at one end to accommodate access to the shortest irons and the putter. Therefore, the golf bags are approximately 34 to 37 inches tall. The golf bag may have at least one wear portion that may cause damage to the travel cover at its upper end. Though, the wear portions may be at anywhere on the outer surface of the golf bag and the golf bag travel cover may comprise a cradle at a point on the interior surface of the enclosure that corresponds to the contact point of the wear portion to the interior surface of the travel cover.

For example, may golf stand bags comprise a stand mechanism. A stand mechanism comprises two rigid connections protruding from a top portion of the golf bag with a leg hingedly connected to each connection portion. The connection portions protrude from the golf bag to allow the legs to extend to an in-use position and to retract to the storage position. In other bags, there may be other protrusions such as, but not limited to, cart connectors, umbrella holders, score card holders, towel holders, handles, clips for straps or other accessories, plastic and metal components, and other attachments to golf bags.

For a golf stand bag, for example, the two protrusions are located between 28 inches and 33 inches from a bottom surface of the golf bag. In a more specific embodiment of the golf stand bag, the two protrusions are located between 29 inches and 32 inches from a bottom surface of the golf bag. A golf cart bag may have similarly sized and located protrusions for connecting the golf bag to a golf cart. See, for example, U.S. Pat. No. 7,004,482, which is incorporated by reference in its entirety.

To accommodate as such a golf stand bag, a travel cover may comprise a cradle at a corresponding internal height in the interior of the travel cover. In a specific example, the cradle may be located from 28 inches to 33 inches from the bottom of the travel cover on the back panel. Further, to allow for movement and golf bags of various sizes and designs, the cradle may have a length or height that is 10% to 20% of the length of the travel cover, in other embodiments, the cradle may have a length that is 12% to 18% of the length of the travel cover and, in some additional embodiments such as a kit comprising a golf bag and matching travel cover, the cradle may have a length that is 15% to 16% of the overall length of the travel cover. The cradle may be much longer in some embodiments, for example, the cradle may be significantly the entire length of the travel cover. For example, the cradle may provide support to back panel of the travel cover.

Various designs of cradles are shown in FIG. 3 to FIG. 6. The embodiment of the cradle 10 shown in FIG. 3 comprises a backing 11 that supports three protrusions or raised ridges, a left raised ridge 12, a center raised ridge 13 and a right raised ridge 14. Between the raised ridges 12 13 and 14 are two recesses, left recess 15 and right recess 16. The cradle 10 may be located on the back panel such that the two protrusions 23 and 24 of the golf bag 20 in FIG. 2 may be received with the recesses 15 and 16 when the golf bag 20 is placed inside the enclosure of the travel cover 30 of FIG. 1. The cradle 10 provides wear protection for the back panel 36 and in addition, reduces the tendency of the golf bag 20 to shift within the enclosure of the travel cover 30.

Figure 3:
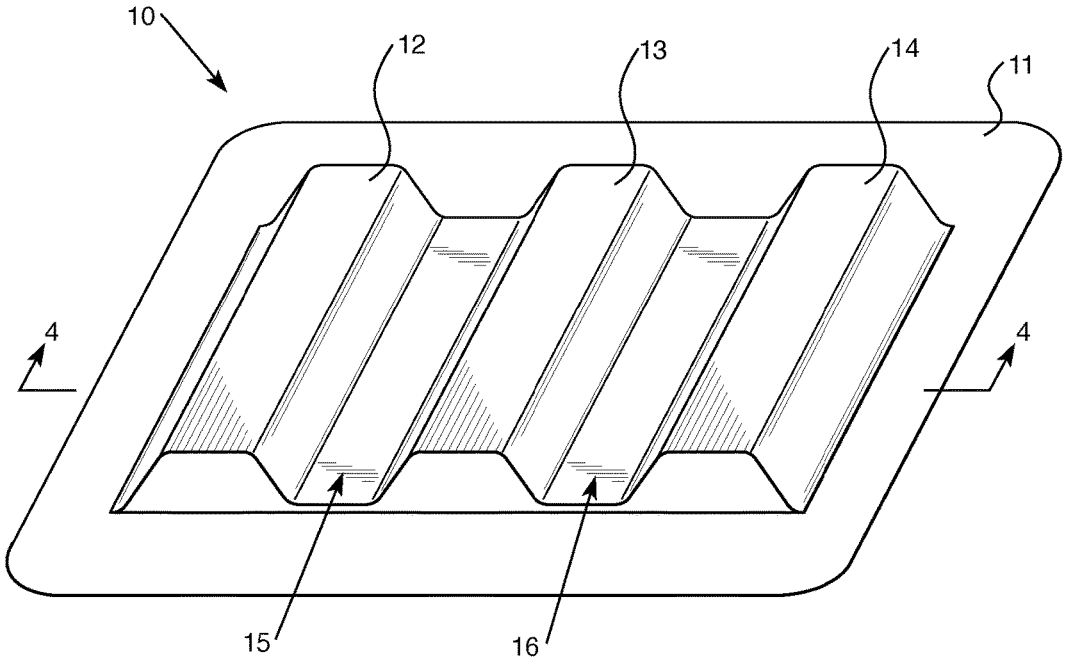
FIG. 3 depicts an embodiment of a cradle having three protrusions or raised ridges that may be connected to the travel cover shown in FIG. 1.
Figure 4:
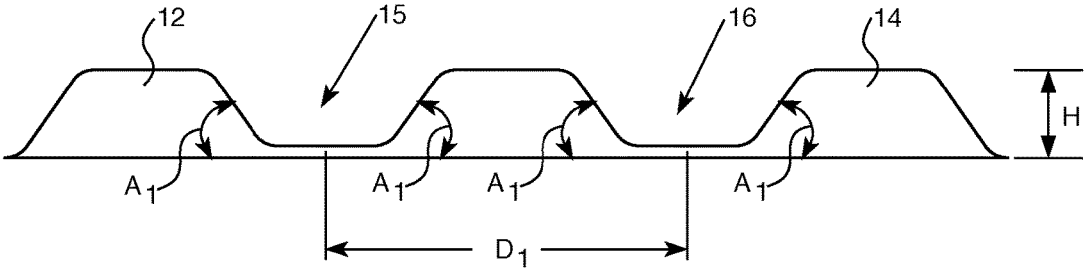
FIG. 4 depicts a cross-sectional view of the cradle shown in FIG. 3.
Figure 5:
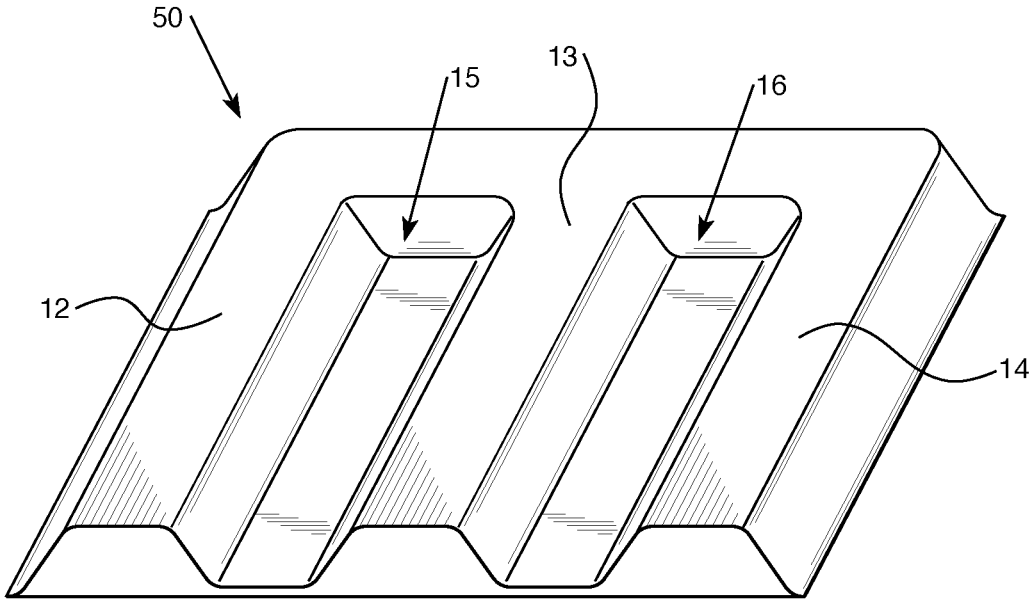
FIG. 5 depicts another embodiment of a cradle having raised ridges define two recesses.

FIG. 4 shows a cross-sectional view of the cradle 10 shown in FIG. 3. In these embodiments of the cradle 10, D1 is the distance between the center portions of the two recesses 15 and 16 and, typically, may be between 3 inches and 6 inches. In one embodiment for standard sized golf bags, D1 is between 4 inches and 5 inches. The distance D1 will correspond with the distance between the protrusions 23 and 24 of the golf bag to be received within the travel cover. In another embodiment, the golf bag may only comprise one protrusion and the corresponding cradle may only have two protrusions or raised ridges to define one recess of receiving the protrusion of the golf bag.

Also shown in FIG. 4, the height H of the protrusions or raised ridges 12 13 and 14 may be greater than the height L of the golf bag protrusions. In such an embodiment, the protrusions or raised ridges 12 13 and 14 support the protrusions 23 and 24 above the bottom of the recesses 15 and 16 to prevent or reduce wear on the back panel 36.

The protrusions or raised ridges 12 13 and 14 also cushion the top portion of the golf bag 20 with the travel cover. Further, in some embodiments, the raised ridges include an angular side walls. The angles A1 make it easier for the protrusions of the golf bag to be received within the recesses of the cradle. The angle may be any desired angle. In one embodiment, the angle A1 may be between 33° and 90°. In another embodiment, the angle A1 may be between 30° and 60° from the backing. This angle is designed merely to allow the golf bag to be easily inserted into the travel cover while still providing protection against wear.

In other embodiments, the cradle may be other shapes as well. For example, the embodiment shown in FIG. 5, the cradle 50 has an additional raised ridge or protrusion 17 that connects the top ends of the protrusions or raised ridges 12 13 and 15. This protrusion or raised ridge 17 creates defines an end of the recess 15 and recess 16 such that the protrusions on the golf bag are limited in their upward sliding movement. Such as cradle 50 would prevent the golf bag from sliding upward and jamming the golf club heads against the top of the enclosure of the travel cover.

Figure 6:
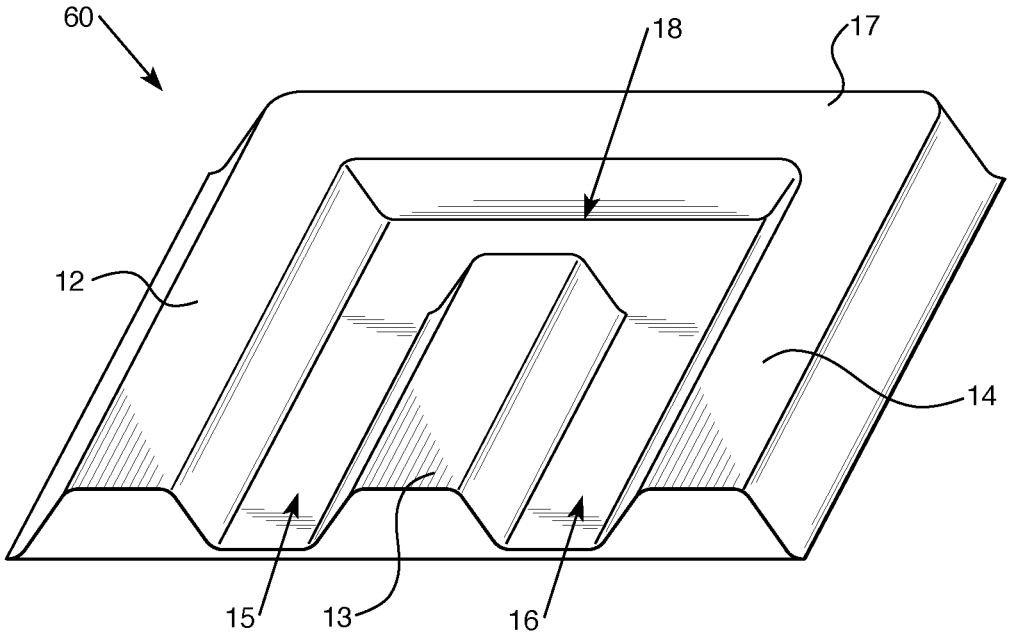
FIG. 6 depicts still another embodiment of a cradle having raised ridges define a U-shaped recess.

A still further embodiment of the cradle 60 is shown in FIG. 6. In this embodiment, the protrusion or raised ridge 17 is connected to the left protrusion or raised ridge 12 and the right protrusion or raised ridge 14 to define a U-shaped recess combining the left recess 15 and the right recess 16. The cradle 60 is an example of a cradle has a shape that is complementary to the shape of the wear portion of the golf bag. The cradle 60 defines a recess that would receive a U-shaped wear portion of a golf bag.

In still further embodiments, the cradle may be a connector that connects to the golf bag. For example, U.S. Pat. No. 7,004,482 describes a foldable golf-bag transporting golf-bag/golf-cart assembly shaped to accommodate a golf bag providing for secure, reversible mounting of bag onto cart. The golf bag has having first and second mounting members protruding from the top portion of the golf bag that are shaped to reversibly mate in sliding dovetail manner into a connecting portion of the golf cart. In such an embodiment, the travel cover may comprise a connecting portion similar to the golf cart such that the golf bag may be detached from the golf cart and then attached to the cradle having a similar connector in the travel cover. In this embodiment, the golf bag, travel cover, and golf cart for a kit that have connectors that function together. In such a golf kit, the golf bag comprises at least one protruding mounting member and the golf cart and the travel cover having similar connectors that are complimentary and can connect to the golf bag independently.

Additionally, for some travel covers, such as the described golf bag travel covers, there may be advantages for the travel cover comprising a rigid top portion. Particularly, for embodiments of the travel covers for golf bags comprising golf clubs, the top portion 35 of the travel cover 30 may comprise a rigid top portion. The rigid top portion provides additional protection against damage during transport to the golf clubs that extend beyond the top of the golf bag. However, travel covers with rigid top portions may also comprise a cradle. The cradle may protect against wear on the flexible portion or allow connection to the golf bag on the rigid portion, for example.

There may be other applications for travel covers that comprise a flexible portion and a rigid top portion. Other travel covers may comprise a complete rigid enclosure, for example, travel covers for tradeshow or conference displays or graphics and/or product samples may benefit from the protection provided by a rigid enclosure.

The means for closing 32 may be selected from the group comprising, but not limited to, zippers, hook and loop closures, buckles, snaps, ties, buttons and/or a combination of such closures.

The embodiment of the golf bag travel covers 30 may further comprise a swivel handle 42 as described in U.S. Pat. No. 8,794,409. The swivel handle 42 may rotate to allow ergonomic pulling or pushing of the travel cover by a traveler to the car, through the airport or hotel, to the golf course, as well as anywhere else.

The embodiments of the described methods and travel covers having at least one cradle are not limited to the embodiments, components, method steps, and materials disclosed herein as such components, process steps, and materials may vary. Moreover, the terminology employed herein is used to describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A travel cover, comprising:

an enclosure defining an inner volume wherein the inner volume is dimensioned to receive a golf bag, wherein the top portion of the golf bag comprises a first protrusion and a second protrusion;

the enclosure comprises:

an opening providing access to the inner volume, and a back panel having a top end and a bottom end, wherein the top end of the back panel comprises a cradle, wherein the cradle comprises three raised portions extending from the top end of the back panel into the inner volume and defining a first recess and a second recess between the three raised portions and the first protrusion and the second protrusion are dimensioned to be received within the first recess and the second recess of the cradle.

2. The travel cover of claim 1, wherein the two protrusions are located between 28 inches and 33 inches from a bottom surface of the golf bag.

3. The travel cover of claim 1, wherein the two protrusions are located between 29 inches and 32 inches from a bottom surface of the golf bag.

4. The travel cover of claim 3, wherein the travel cover is between 46 inches and 49 inches long.

5. The travel cover of claim 1, wherein the two protrusions are between 1 inch and 3 inches in length.

6. The travel cover of claim 1, wherein the back panel is opposite of the opening.

7. The travel cover of claim 1, wherein the golf bag is a stand golf bag and the golf bag has a first leg and a second leg and the first leg is connected to the first protrusion and the second leg is connected to the second protrusion.

8. The travel cover of claim 1, wherein the first protrusion and the second protrusion are designed to connect the golf bag to a golf cart or designed to connect stand legs to the golf bag.

9. The travel cover of claim 1, wherein three raised portions comprise a left raised portion, a center raised portion, and a right raised portion and the first protrusion is received in the first recess defined between the left raised portion and the center raised portion, the second protrusion is received in the second recess defined between the center raised portion and the right raised portion, and the top portion of the golf bag contacts the center raised portion.

10. The travel cover of claim 9, wherein the center raised portion has a height greater than the height of either of the first protrusion and the second protrusion.

11. A golf bag with a travel cover, comprising:

a golf bag comprising a top member defining an opening to place golf clubs; a first protrusion connected to the top member; and a second protrusion connected to the top member; wherein the first protrusion and the second protrusion define a recess between the first protrusion and the second protrusion;

a golf bag travel cover comprising an enclosure defining an inner volume dimensioned to receive the golf bag, wherein the golf bag travel cover comprises a cradle having a raised portion, wherein at least a portion of the raised portion is received within the recess with the golf bag within the golf bag travel cover.

12. The golf bag with a travel cover of claim 11, wherein the cradle defines a first recess and a second recess and the first protrusion is received within the first recess and the second protrusion is received within the second recess with the golf bag within the golf bag travel cover.

13. The golf bag with a travel cover of claim 12, wherein the golf bag travel cover comprises a back panel and the cradle is connected to the back panel.

14. The golf bag with a travel cover of claim 11, wherein a height of the first protrusion and a height of the second protrusion are greater than a height of the raised portion of the golf bag travel cover.

15. A golf bag travel cover, comprising:

an enclosure defining an inner volume wherein the inner volume is dimensioned to receive a golf bag comprising two protrusions, wherein the enclosure comprises:

an opening providing access to the inner volume, and a back panel having a top end and a bottom end, wherein the top end of the back panel comprises a cradle, wherein the cradle comprises a backing connected to the back panel, a left raised ridge, a center raised ridge, and a right raised ridge forming two recesses between the raised ridges and the two recesses are dimensioned to receive the two protrusions when the golf bag is placed inside the enclosure.

16. The golf bag travel cover of claim 15, wherein the cradle provides wear protection for the back panel and reduces the tendency of the golf bag to shift within the enclosure.

17. The golf bag travel cover of claim 15, wherein the left raised ridge, the center raised ridge, and the right raised ridge are located between 28 inches and 33 inches from a bottom surface of the golf bag.

18. The golf bag travel cover of claim 17, wherein the center raised ridge has height that is greater than a height of each of the protrusions.

19. The golf bag travel cover of claim 15, wherein the recesses have center portions and the center portions of the two recesses are between 3 inches and 6 inches apart.

20. The golf bag travel cover of claim 19, each of the raised ridges include angular side walls, wherein the angular side walls are at an angle between 30° and 60° from the backing.

* * * * *